US007624690B2

(12) United States Patent
Beaumont et al.

(10) Patent No.: US 7,624,690 B2
(45) Date of Patent: Dec. 1, 2009

(54) STARVED AIR INCLINED HEARTH COMBUSTOR

(75) Inventors: E. Larry Beaumont, Littleton, CO (US); Edward P. Champagne, Westfield, MA (US); Joseph A. Giardina, Cheshire, MA (US); Chester L. Halek, Lee, MA (US); Joseph W. McCarthy, North Andover, MA (US); Kevin J. O'Rourke, Wilbraham, MA (US); E. Scott Porter, Wilbraham, MA (US); Mark N. Rice, Chester, MA (US); Kevin G. Rousseau, Windsor, MA (US)

(73) Assignee: eco/Technologies, LLC, Albany, NY (US)

( * ) Notice: Subject to any disclaimer, the term of this patent is extended or adjusted under 35 U.S.C. 154(b) by 0 days.

(21) Appl. No.: 11/543,446

(22) Filed: Oct. 5, 2006

(65) Prior Publication Data

US 2007/0028816 A1 Feb. 8, 2007

Related U.S. Application Data

(62) Division of application No. 11/128,033, filed on May 12, 2005, now Pat. No. 7,146,916.

(60) Provisional application No. 60/571,357, filed on May 14, 2004.

(51) Int. Cl.
*F23K 3/10* (2006.01)

(52) U.S. Cl. ..... 110/108; 110/165 R; 110/300

(58) Field of Classification Search ..... 110/346, 110/188, 190, 214, 297, 298, 204, 211, 342, 110/344, 345, 165 A, 165 R, 299, 300, 108, 110/101 R, 101 A, 109, 327, 293, 289, 290, 110/291, 267, 255, 259; 126/152 A, 152 B, 126/152 R See application file for complete search history.

(56) References Cited

U.S. PATENT DOCUMENTS 1,943,949 A * 1/1934 Coghlan et al. ..... 110/165 A (Continued)

FOREIGN PATENT DOCUMENTS

| | | | |
|---|---|---|---|
| EP | 0288597 | | 11/1988 |
| EP | 0382045 | A2 * | 8/1990 |
| WO | WO03001113 | * | 1/2003 |

*Primary Examiner*—Kenneth B Rinehart
(74) *Attorney, Agent, or Firm*—Hoffmann & Baron, LLP

(57) ABSTRACT

An inclined hearth combustor which generally includes a primary combustion chamber having a plurality of stepped hearths, a secondary combustion chamber in communication with the primary combustion chamber and a boiler having an inlet in communication with the secondary combustion chamber. The secondary combustion chamber includes a refractory-lined cyclone separator for removing fly ash from combustion gases exiting the primary combustion chamber and the boiler inlet is surrounded by the cyclone separator. The primary combustion chamber may further include an ash transfer ram movably disposed between two stepped hearths, wherein the ash transfer ram includes a top layer of refractory material extending rearwardly from a leading edge thereof. The ash transfer ram may further include a plurality of V-shaped wheels attached to a bottom surface thereof, a replaceable wear plate disposed on a side surface thereof and/or a wiper blade fixed on a forward face thereof. At least one hearth may include two spaced rows of air feed-tubes longitudinally embedded therein for delivering a combustion gas into the combustion chamber. The air-feed tubes may intersect with an air distribution plenum for simultaneously delivering the combustion gas to the air feed-tubes. The primary combustion chamber may further include a reciprocating loader ram movably disposed on the top surface of the top-most hearth for pushing combustible material on the top-most hearth, wherein the loader ram has a bottom surface and at least one longitudinally extending replaceable wear strip disposed thereon.

20 Claims, 6 Drawing Sheets

U.S. PATENT DOCUMENTS

| | | | | |
|---|---|---|---|---|
| 2,592,701 | A | | 4/1952 | Jackson |
| 4,373,507 | A | | 2/1983 | Schwartz et al. |
| 4,479,441 | A | | 10/1984 | Somodi |
| 4,510,873 | A | | 4/1985 | Shigaki |
| 4,534,301 | A | | 8/1985 | Sakash et al. |
| 4,676,176 | A | * | 6/1987 | Bonomelli ..... 110/281 |
| 5,626,089 | A | * | 5/1997 | Schneider et al. ..... 110/281 |
| 6,655,304 | B1 | | 12/2003 | Barlow |

* cited by examiner

STARVED AIR INCLINED HEARTH COMBUSTOR

CROSS-REFERENCE TO RELATED APPLICATIONS

This application is a divisional application of U.S. application Ser. No. 11/128,033, filed May 12, 2005, now U.S. Pat. No. 7,146,916, which claims the benefit of U.S. Provisional Application No. 60/571,357, filed on May 14, 2004.

FIELD OF THE INVENTION

The present invention relates generally to improvements in starved air inclined hearth combustors, wherein "starved air" is used to define a combustor having a primary chamber which combusts a fuel, such as municipal waste, in the presence of oxygen, but which requires a subsequent secondary chamber for efficient and environmentally superior completion of combustion.

BACKGROUND OF THE INVENTION

In an era of renewable energy demand and distributed power generation sources, there is an urgent need for small (less than 150 tons per day) municipal waste combustors (MWCs) that can achieve superior environmental performance at a competitive capital cost and operating and maintenance cost.

U.S. Pat. No. 4,479,441 to Somodi discloses various improvements in previous inclined hearth municipal waste combustors (MWCs) to address problems with underfire combustion air systems that tended to become plugged up with molten materials from the municipal solid waste stream. However, drawbacks with the system disclosed by Somodi include: 1) excessive operating and maintenance cost; and 2) combustion inefficiency.

It is therefore desirable to provide improvements on the Somodi design for underfire air systems that also address numerous other "next generation" design improvements for starved air inclined hearth MWCs.

SUMMARY OF THE INVENTION

An improved inclined hearth combustor formed in accordance with the present invention generally includes a primary combustion chamber having a plurality of stepped hearths, a secondary combustion chamber and a boiler. The primary combustion chamber and secondary combustion chambers are provided with various improvements over the prior art that result in reduced construction cost, reduced operating and maintenance costs and better combustion efficiency.

In a preferred embodiment, the height of the primary combustor ceiling at the loader ram area is increased and a minimum height of four feet is provided between the underside of the last hearth and the bottom floor at the opposite end of the primary combustor. Also, the bottom four feet of the primary combustor side walls are preferably constructed with poured refractory material and the remaining upper portion of the primary combustor side walls is preferably lined with a sprayed refractory material. The primary combustor chamber further preferably includes a dry ash handling system having a mechanical boiler air seal to remove the combusted ash particles from the combustor.

The secondary combustor of the present invention preferably comprises a refractory-lined cyclone separator disposed at the primary combustor chamber exit and surrounding the boiler gas inlet. The cyclone separator preferably includes a flue gas recirculation inlet for inputting heated flue gas coming back from the boiler outlet and an ash lock at the bottom of the cyclone separator to capture the fly ash removed from the combustion gas.

The ash transfer rams of the present invention's primary combustor preferably include a top layer of refractory material, in place of steel, and have V-shaped wheels that ride on correspondingly shaped tracks situated rearwardly from the hearths. The ash transfer rams also preferably include easily replaceable steel wear plates disposed on the sides of the ash transfer rams and a forward-scooping wiper blade fixed on the bottom of its front face. Additionally, in a preferred embodiment, below each transfer ram is at least one small ash collection conveyor to collect any refuse spillage from the ram as the ram is retracted back under the hearth.

The primary combustor of the present invention further preferably includes a reciprocating loader ram having a plurality of wear strips extending longitudinally on its bottom surface and the top surface of the first hearth has at least one steel guide strip interposed between a pair of the wear strips to restrict loader ram motion parallel with the side walls of the primary combustor.

The hearths of the present invention's primary combustor preferably include an upper and a lower row of plural parallel underfire air-feed tubes with clean-out pistons slidably disposed in the air feed-tube. Combustion air is fed to these underfire air-feed tubes via an air distribution plenum extending transversely across and under the upper step of each hearth. The upper and lower underfire air-feed tubes ports may be fed via a combined plenum or via two independent plenums.

As a result of the present invention, numerous modifications to a conventional starved air inclined hearth combustor, such as a municipal waste combustor (MWC), are provided that result in reduced construction cost, reduced operating and maintenance cost, reduced slagging of materials on the hearths, better combustion efficiency, better control of the process, better air seals, and improvement of the underfire air system.

A preferred form of the starved air inclined hearth combustor, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

The present invention is directed to inclined hearth combustors, and more particularly, municipal waste combustors. Combustors of this type are shown and described in U.S. Pat. No. 4,479,441 to Somodi, issued Oct. 30, 1984, the disclosure of which is incorporated by reference.

Figure 1:
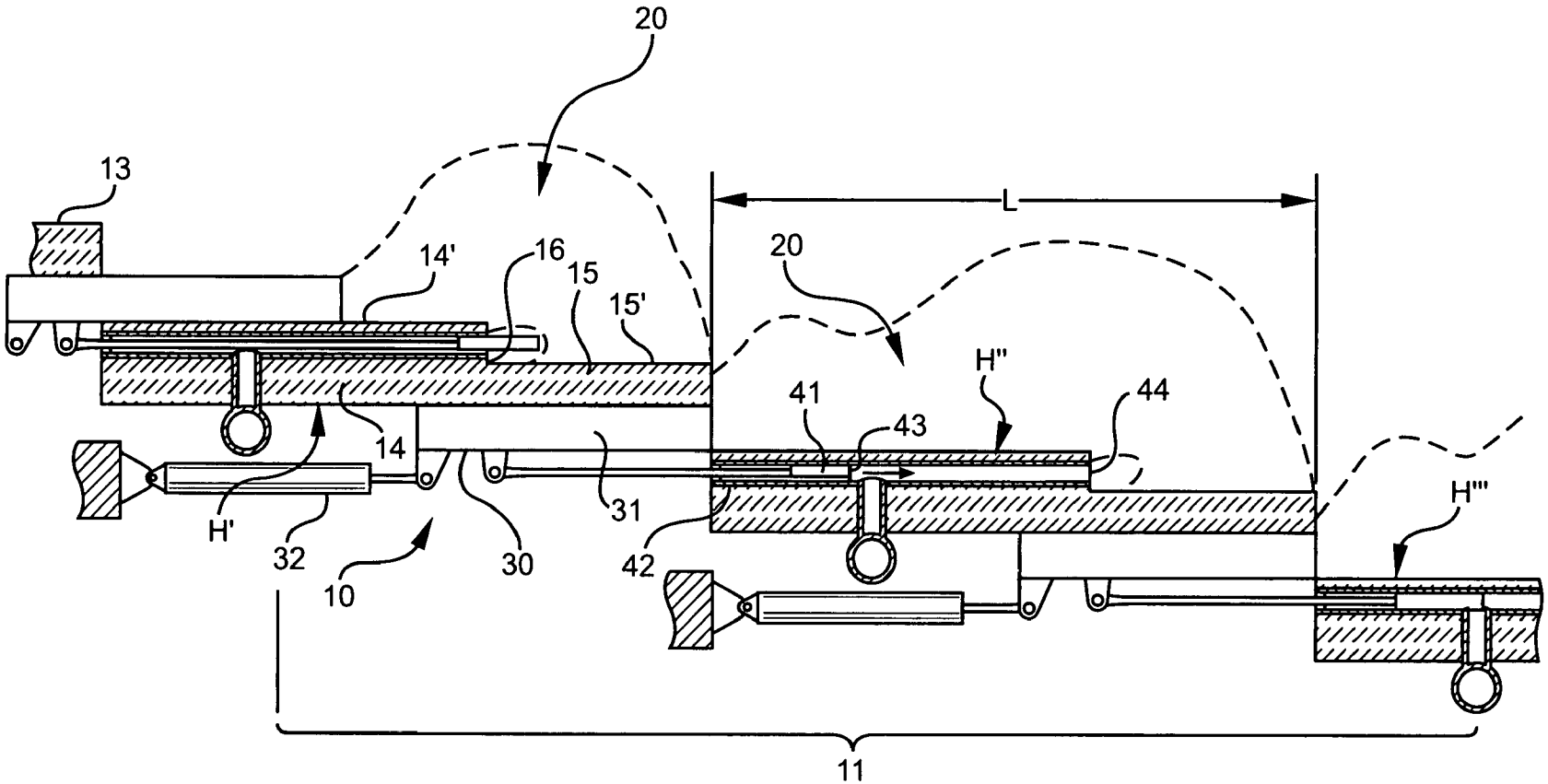
FIG. 1 (Prior Art)
FIG. 1 is a side cross-sectional view which diagrammatically illustrates the relevant portions of a conventional inclined hearth municipal waste combustor of the prior art.

Referring first to FIG. 1, a conventional prior art inclined or "stepped" hearth municipal waste combustor 10 (MWC) generally includes a floor 11 comprising plural stepped hearths H', H", H'" et seq., descendingly arranged. The stepped hearths support waste 20 to be combusted in a generally elongated combustion chamber defined by a housing comprising a steel shell with side walls, roof and floor portions.

Each stepped-hearth H', H", H'" et seq is typically constructed of refractory material and supported within the shell on structural steel. H' is shown as the first, or uppermost hearth which extends longitudinally into the combustion chamber, stepped down from the loading hearth 13 just inside the loading door (not shown) of the combustor. Typically, each hearth has an upper portion 14, having a first top surface 14', and a lower portion 15, having a second top surface 15', the portions being integral with the hearth H' and separated by a vertical portion 16 of the hearth.

A ram means 30 is provided between each hearth having a main ram body 31 which reciprocates over the upper portion 14 by a reciprocating means 32, typically a fluid-actuated cylinder, to push waste over the upper portion 14 and lower portion 15, and down onto the next stepped hearth H". The ram pushes burning waste from the surface of an upper hearth to a lower one, thus advancing and agitating the burning waste to promote better combustion.

Embedded within or disposed beneath the upper portion 14 of hearth H', and disposed in substantially horizontally spaced-apart relationship with each other are plural parallel underfire air feed-tubes 42 disposed above a plane defined by the top surface 15' of the lower portion 15. A clean-out piston 41 is slidably disposed in the underfire air feed-tube 42, so that at the end of the stroke, a leading surface 43 of the clean-out piston travels past the mouth 44 of the underfire air feed-tube to ensure that waste material being combusted near the mouth 44 does not adhere and build up within or near the mouth to plug it. Additionally, travel of the clean-out piston 41 into the waste also forms an indentation, void or cavity in the waste, so that air from the underfire air feed-tube 42 can more easily permeate the waste to facilitate combustion.

In operation, a controlled amount of combustion air is supplied to the underfire air feed-tubes and solid waste is fed to the combustion chamber upon the loading hearth thereof, and ignited. Upon ignition of the waste, combustion is self-sustaining. As the solid waste burns, fresh solid waste is fed to the combustion chamber and the ram on the uppermost hearth pushes the burning waste onto a lower hearth.

Figure 2:
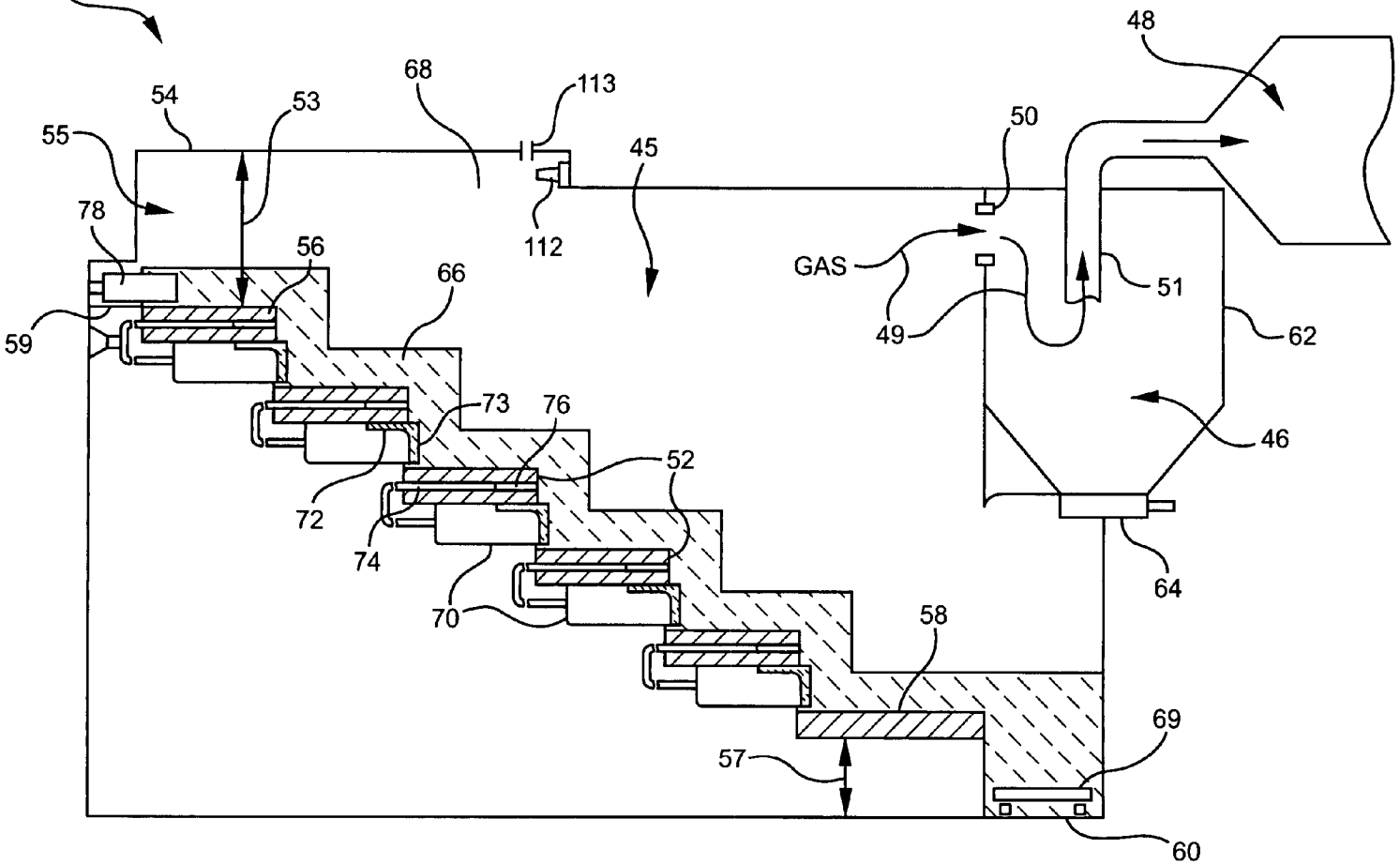
FIG. 2 is a side cross-sectional view which diagrammatically illustrates the relevant portions of the inclined hearth combustor of the present invention.
Figure 3:
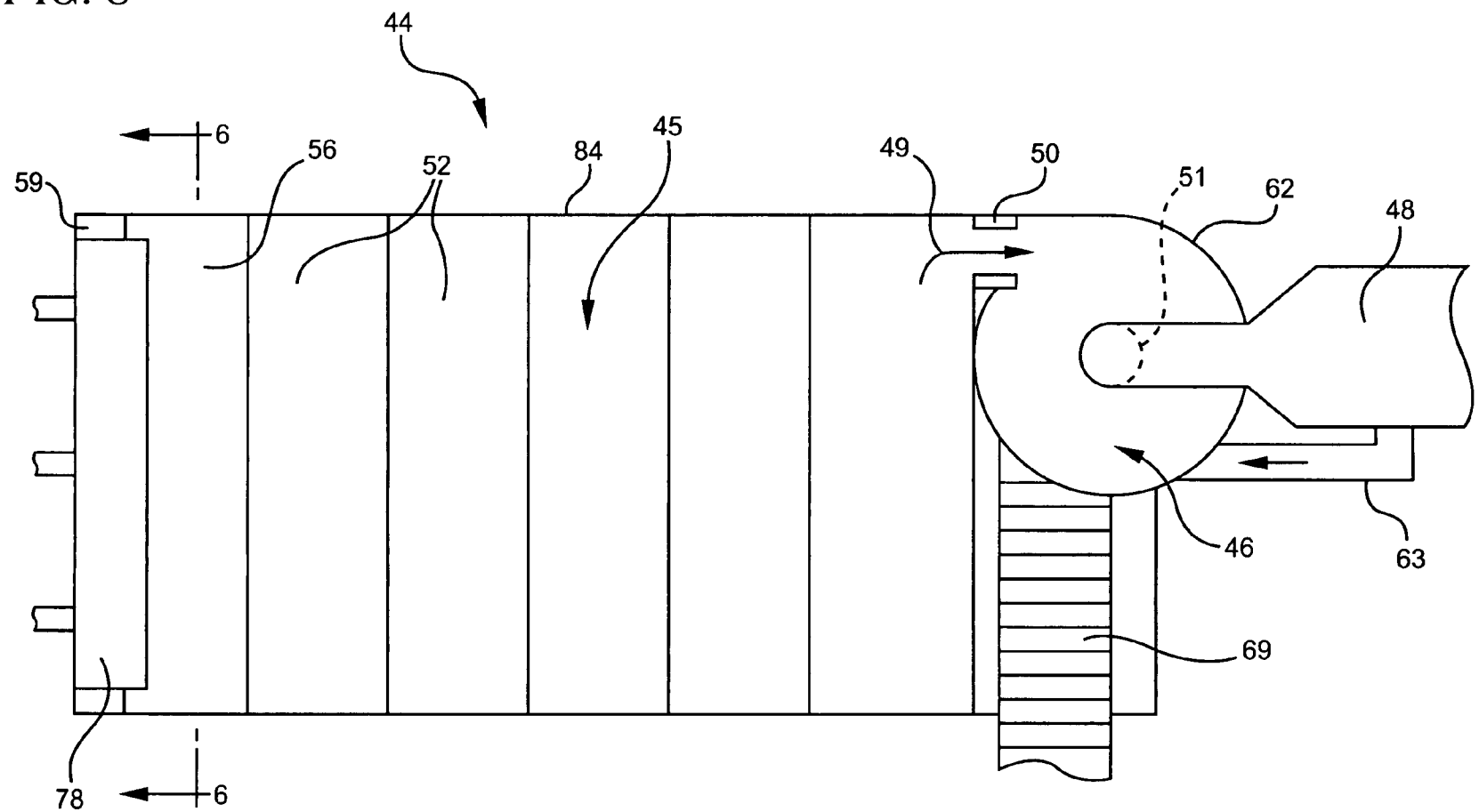
FIG. 3 is a top view of the inclined hearth combustor shown in FIG. 2.
Figure 5:
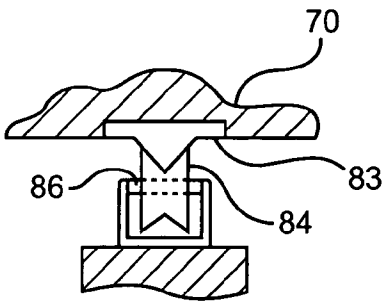
FIG. 5 is a cross-sectional view of one of the wheels of the ash transfer ram shown in FIG. 4, taken along the line 5-5.

FIGS. 2 and 3 show an improved inclined hearth combustor 44 in accordance with the present invention. In a preferred embodiment, the combustor 44 is a municipal waste combustor, but the invention is not limited to only such types of combustors.

The combustor 44 generally includes a primary combustion chamber 45, a secondary combustion chamber 46 and a boiler 48, all in fluid communication. Combustion gas 49 from the primary combustion chamber 45 is delivered to the secondary combustion chamber 45 via an opening or passage 50 located at an upper portion of the primary combustion chamber. The combustion gas 49 is then delivered to the boiler 48 via a boiler gas inlet 51.

The primary combustion chamber 45 is bounded by side walls, a combustor ceiling and an inclined arrangement of stepped hearths. Preferably, there are five or six hearths, depending on unit combustion capacity and fuel heating value, for optimum residence time and burn out.

The height 53 of the primary combustor ceiling 54 at the loader ram area 55 is increased, as compared to prior art combustors, to allow better combustion of dry waste and to eliminate overheating and damage to the refractory material. The loader ram areas in prior art combustors are too small causing overheating of the dry waste as it is fed onto the first hearth 56, resulting in slagging on the hearth that is difficult to remove and damage to the surrounding refractory due to overheating. Preferably, the height 53 of the primary combustor ceiling 54 at the loader ram area 55 is increased to at least ten (10) feet. This allows for gas expansion in this area when burning dry waste. Additionally, at the opposite end of the primary combustor 45, a minimum height 57 of four (4) feet should be provided between the underside of the last hearth 58 and the bottom floor 60 to allow better access for cleaning and maintenance.

The secondary combustor 46 of the present invention preferably comprises a refractory-lined cyclone separator 62 disposed at the primary combustor chamber exit 50 and surrounding the boiler gas inlet 51. The cyclone separator 62 removes fly ash from the combustion gases 49 before entering the waste heat boiler 48, thus reducing tube pluggage and the frequency of boiler tube cleaning. The cyclone separator preferably includes a flue gas recirculation inlet 63, as shown in FIG. 3, for inputting heated flue gas coming back from the boiler 48. An ash lock 64 is also provided at the bottom of the cyclone separator 62 to capture the fly ash removed from the combustion gas 49.

The bottom four feet 66 of the primary combustor side walls, adjacent to each hearth 52 is preferably lined with poured refractory material, instead of brick, to reduce construction and maintenance cost. As shown in FIG. 2, the remaining upper portion 68 of the primary combustor side walls is preferably lined with a sprayed refractory material, instead of brick, to allow lower construction cost.

Disposed on the forward most floor 60 of the primary combustor chamber 45 is a dry ash handling system 69 having a mechanical boiler air seal to remove the combusted ash particles from the combustor. Using a dry conveyor-type system 69 reduces the cost of ash handling typically associated with wet quench systems and improves the quality of ash for commercial ash reutilization programs. A dry conveyor system 69 also allows for combined processing of dry bottom ash and fly ash.

Like conventional combustors, the primary combustor 45 of the present invention includes ash transfer rams 70 movably disposed between the hearths 52. Conventional ash transfer rams are typically made entirely out of steel. However, the ash transfer rams 70 of the present invention include a top layer 72 of refractory material in place of the steel. The top refractory layer 72 is about 3 inches in thickness and extends about 4 feet rearwardly from the leading edge 73 of the ram (i.e., the end of the ram facing the inside of the primary combustor 45). It has been found that utilizing a top refractory layer 72 on the rams 70 tightens air seals and reduces maintenance cost. In a preferred embodiment, the leading edge 73 of the ram is also covered with the refractory layer 72 integrally with the top layer. Preferably, the refractory material 72 at the leading edge 73 is sloped downwardly to form a forward "nose" on the ash transfer ram 70.

Figure 4:
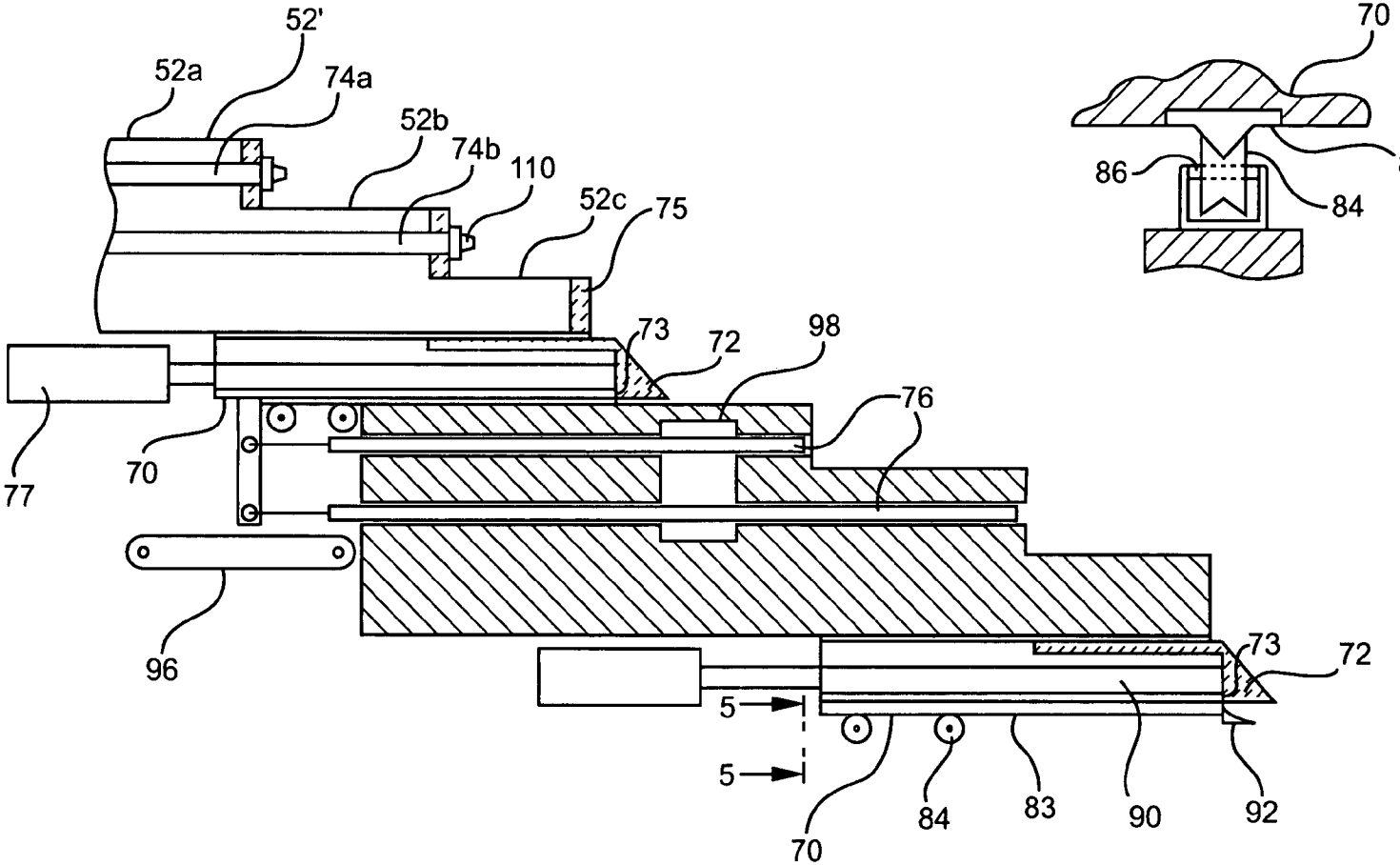
FIG. 4 is an enlarged and detailed cross-sectional view of two of the hearths of the combustor shown in FIG. 2.

Also like conventional combustors, the hearths 52 of the present invention include plural parallel air feed-tubes 74 embedded therein with clean-out pistons 76 slidably disposed in the air feed-tube. However, in a preferred embodiment of the present invention, the hearths 52' are made thicker to allow two rows of underfire air ports 74*a* and 74*b* in each step, as shown in FIG. 4. Moreover, in a preferred embodiment, each hearth 52' is itself stepped to include an upper hearth portion 52*a*, a middle hearth portion 52*b* below and extending forward from the upper portion and a lower hearth portion 52*c* below and extending forward from the middle portion. The upper hearth portion 52*a* includes a row of underfire air ports 74*a* embedded therein and the middle hearth portion 52*b* includes a row of underfire air ports 74*b* embedded therein. It is further conceivable to include a third row of underfire air ports (not shown) in the lower hearth portion 52*c*.

Also, whether stepped or not, the thicker hearths 52' preferably include a thicker refractory layer 75 on their noses to reduce frequency of repair. The present invention also utilizes longer clean-out piston push rods 76 that preferably extend up to 18 inches into the fuel pile for better distribution of underfire air and better combustion efficiency. The piston push rods 76 are mechanically coupled to a respective ash transfer 70, and both are driven by a reciprocating means 77 in a conventional manner.

Figure 6:
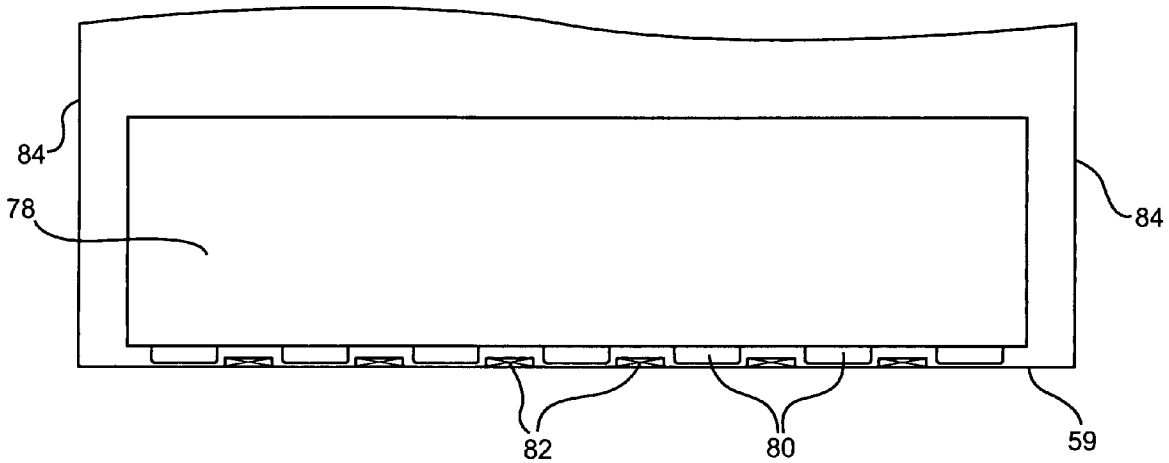
FIG. 6 is a front view of the loader ram shown in FIG. 3 taken along the line 6-6.

Returning to FIGS. 2 and 3, the primary combustor 45 also includes a reciprocating loader ram 78 for pushing refuse dumped in the loader ram area 55 onto the first hearth 56. Referring additionally to FIG. 6, the bottom surface of the loader ram 78 includes a plurality of wear strips 80 extending longitudinally in the direction of travel of the loader ram. The wear strips 80 support the loader ram 78 and are guided along the top surface of the loader ram hopper 59, located external to the loader ram area 55, to prevent excessive wear. When the wear strips 80 become worn down, only the strips need replacing. Fixed to the floor of the hopper 59 is at least one steel guide strip 82. The guide strips 82 are positioned on the floor of the hopper 59 so as to be interposed between pairs of wear strips 80 on the loader ram 78. The guide strips 82 restrict loader ram motion parallel with the side walls 84 of the primary combustor 45. The guide strips 82 also improve the air seal between the ram 78 and the floor and minimize jams caused by bulky objects.

In a preferred embodiment, the ash transfer rams are provided with longitudinal V-shaped tracks 83 which ride in correspondingly sized V-shaped wheels 84 situated rearwardly from the hearths 52. Alternatively, the ash transfer rams 70 may be provided with V-shaped wheels that ride on cooperating V-shaped tracks. In either case, the cooperating V-shape between the wheels 84 and the tracks 83 serve to eliminate side-to-side movement and improve air seals. It has also been found that increasing the diameter of the wheel axles 86 to two inches provides preferred results.

The ash transfer rams 70 also preferably include sacrificial steel wear plates 90 disposed on their sides, which contact the side walls 84 of the primary combustor 45, as shown in FIG. 4. Like the wear plates 80 of the loader ram 78 described above, to simplify maintenance and repair, when the ash transfer ram wear plates 90 wear down, only the plates need to be replaced, as opposed to the entire ash transfer ram 70.

Also, each ash transfer ram 70 further preferably includes a forward-sloping wiper blade 92 fixed on the bottom of its front face 73. The wiper blade 92 is protected by the poured refractory layer 72 disposed on the top and forward portions of the ash transfer ram 70. The wiper blade 92 is similar to and functions in the same manner as a snow plow to clear the refuse on the hearth 52 as the ash transfer ram moves forward. The wiper blade 92 also reduces ash drag-back on ash transfer ram retraction.

Additionally, below each transfer ram 70 is at least one small ash collection conveyor 96, as shown in FIG. 4, to collect any refuse spillage from the ram as the ram is retracted back under the hearth. Preferably there is one conveyor 96 on each lateral side of the ash transfer ram adjacent the side walls of the primary combustor 45 so as not to interfere with the clean-out pistons 76. The conveyor 96 carries the spillage away from the ash transfer ram machinery to reduce cleanup and maintenance cost.

Figure 7:
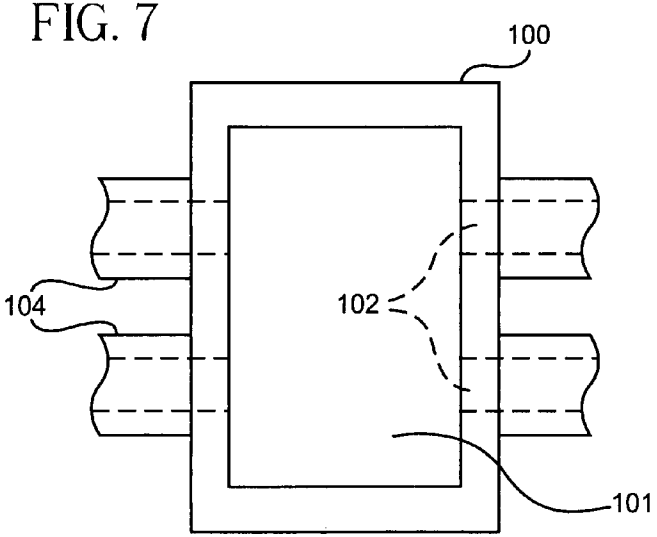
FIG. 7 is a cross-sectional view of a preferred embodiment of an underfire air port plenum.

Combustion air is fed to the underfire air ports 74*a* and 74*b* via an air distribution plenum 98 extending transversely across and under the upper step of each hearth 52. Thus, each underfire air port 74*a* and 74*b* is in open communication at a perpendicular angle relative to the longitudinal axis of the port. The upper 74*a* and lower 74*b* underfire air ports may be fed via a combined plenum 98, as shown in FIG. 4, or via two independent plenums. The plenum 98 may simply be a bore intersecting transversely with the underfire air ports 74*a* and 74*b*. However, in a preferred embodiment, the plenum 98 takes the form of a hollow elongate member 100 having a longitudinal central bore 101 and a series of spaced-apart holes 102 formed therethrough and extending perpendicularly to the central bore, as shown in FIG. 7. Also, hollow pipe members 104 are preferably welded to the plenum 98 at each hole 102 to serve as guides for the clean-out piston push rods 76. Each hollow pipe member is wrapped with insulation.

Figure 8:
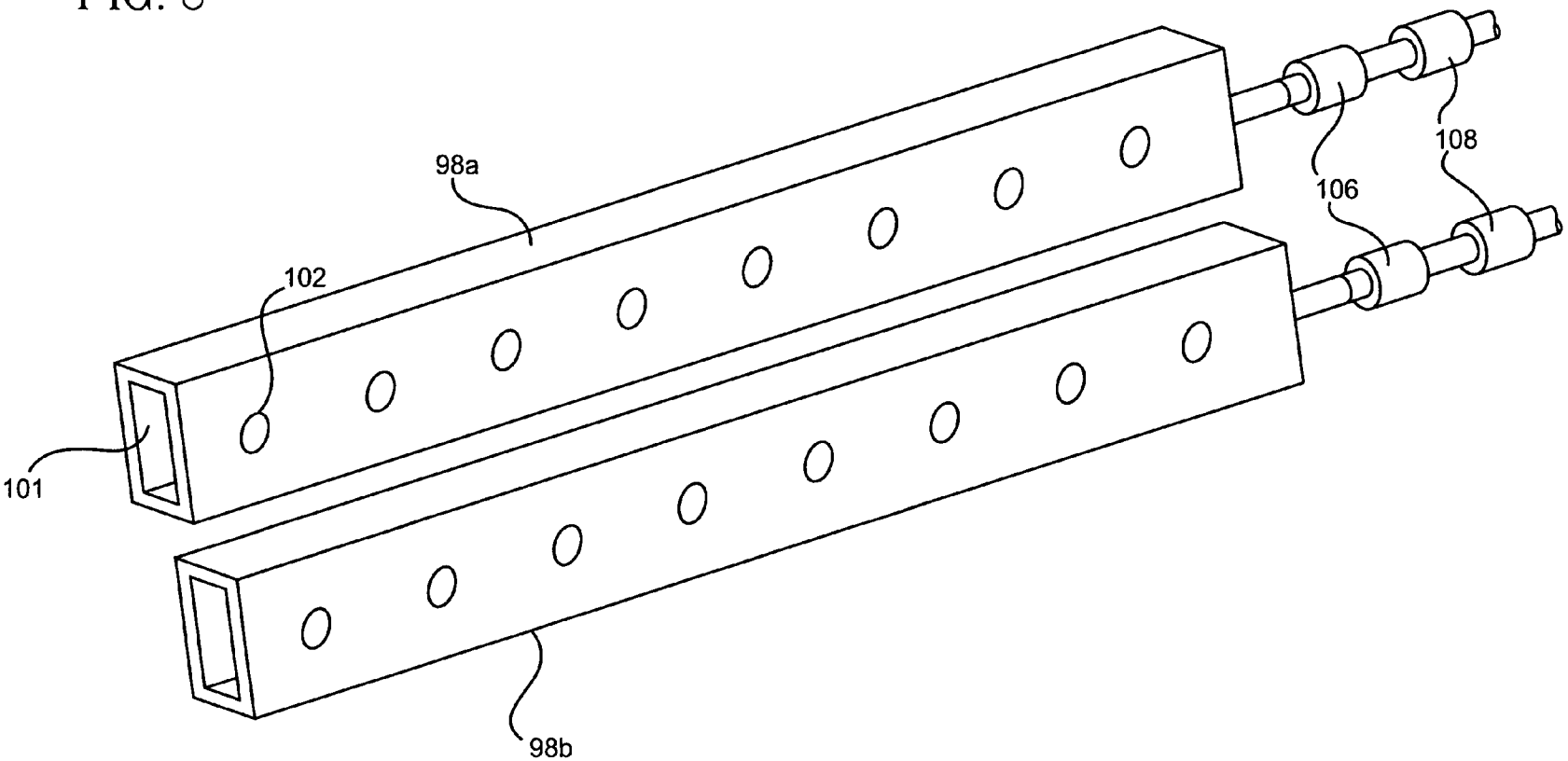
FIG. 8 is a perspective view of two independent plenums feeding the underfire air tubes formed in accordance with the present invention.

As mentioned above, the plenum may be provided as independent plenums 98*a* and 98*b* for feeding respective rows of underfire ports 74*a* and 74*b*, as shown in FIG. 8. In either case, each air mixing plenum 98 preferably includes a pinch control valve 106 and a polishing baghouse 108 at each source and at each hearth. The pinch control valve 106 allows mixing and balancing of fresh cold air, fresh hot air, recirculated flue gas, pure oxygen, and/or small amounts of hydrogen for improved combustion efficiency. The polishing baghouse 108, similar to a vacuum cleaner filter, removes dust that can cause clogs to the underfire air system.

The underfire air ports 74*a* and 74*b* preferably terminate at stainless steel underfire air nozzles 110. Additionally, stainless steel overfire air nozzles 112 and stainless steel primary recirculating flue gas injection slots 113 are preferably provided in the ceiling 54 of the primary combustion chamber 45, as shown in FIG. 2. It has been found in these applications that the stainless steel nozzles provide for significantly longer life.

The entire system 10 according to the present invention is preferably provided with instrumentation and controls to allow modulated control of individual ram insertion length and timing for optimizing burnout of fuel. Also, easily replaceable stainless steel oxygen sensor probes are preferably provided at each hearth for feedback control for improved combustion. Additionally, a variable speed drive on underfire air fan with feedback control on fan electrical current is preferably provided to optimize delivery of underfire air without slagging.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An inclined hearth combustor comprising:

a plurality of stepped hearths including a top-most hearth;

a loader ram hopper disposed rearward of said top-most hearth, said hopper having a floor surface; and a reciprocating loader ram movably disposed on said floor surface of said hopper for pushing combustible material forward on to said top-most hearth, said loader ram having a bottom surface and at least one longitudinally extending replaceable wear strip disposed on said bottom surface for reducing wear thereon, said wear strip making sliding contact with said floor surface of said hopper, wherein said floor surface of said hopper includes at least one longitudinally extending guide strip disposed thereon and said bottom surface of said loader ram includes two wear strips spaced apart to receive said guide strip therebetween for guiding longitudinal travel of said loader ram.

2. An inclined hearth combustor as defined in claim 1, further comprising:

a primary combustion chamber having said plurality of stepped hearths, said loader ram hopper and said reciprocating loader ram;

a secondary combustion chamber in communication with said primary combustion chamber, said secondary combustion chamber including a refractory-lined cyclone separator for removing fly ash from combustion gases exiting said primary combustion chamber; and a boiler having an inlet in communication with said secondary combustion chamber, said boiler inlet being surrounded by said cyclone separator.

3. An inclined hearth combustor as defined in claim 2, wherein said cyclone separator includes a flue gas recirculating inlet for feeding heated flue gas from said boiler into said secondary combustion chamber.

4. An inclined hearth combustor as defined in claim 2, wherein said cyclone separator includes an ash lock provided at a bottom thereof for capturing the fly ash removed from the combustion cases exiting said primary combustion chamber.

5. An inclined hearth combustor as defined in claim 1, further comprising an ash transfer ram movably disposed between two of said stepped hearths, said ash transfer ram including a layer of refractory material disposed on a forward face thereof and extending rearwardly from said end on a top surface thereof.

6. An inclined hearth combustor as defined in claim 1, wherein at least one of said stepped hearths comprises at least two spaced rows of air feed-tubes longitudinally embedded therein, said air feed-tubes terminating at a front face of said hearth for delivering a combustion gas into said combustor.

7. An inclined hearth combustor as defined in claim 6, wherein said hearth comprises an upper hearth portion and a lower hearth portion, said lower hearth portion disposed below and extending forward from said upper portion to form a stepped hearth, said upper hearth portion including a row of underfire airports embedded therein and said lower hearth portion including a row of underfire airports embedded therein.

8. An inclined hearth combustor as defined in claim 6, wherein said front face of said hearth is lined with a refractory material.

9. An inclined hearth combustor as defined in claim 6, further comprising an air distribution plenum extending transversely across and intersecting with at least one row of said air feed-tubes embedded in said hearth for simultaneously delivering the combustion gas to at least one row of said air feed-tubes.

10. An inclined hearth combustor as defined in claim 9, wherein said air distribution plenum further comprises an elongate member having a central bore and a plurality of transverse holes communicating with said central bore for providing fluid communication between said central bore and said air feed-tubes.

11. An inclined hearth combustor as defined in claim 10, wherein said air distribution plenum further comprises a pinch control valve connected with said central bore for controlling the mixture of the combustion gas fed into said central bore.

12. An inclined hearth combustor as defined in claim 10, wherein said air distribution plenum further comprises a filter connected with said central bore for filtering the combustion gas fed into said central bore.

13. An inclined hearth combustor as defined in claim 1, further comprising:

an ash transfer ram movably disposed between two of said stepped hearths, said ash transfer ram having a V-shaped track disposed on a bottom surface thereof; and at least one V-shaped wheel supported between said two stepped hearths for receiving said V-shaped track of said ash transfer ram.

14. An inclined hearth combustor as defined in claim 1, further comprising:

a side wall extending upwardly adjacent a lateral end of said hearths; and an ash transfer ram movably disposed between two of said stepped hearths, said ash transfer ram including a side surface substantially parallel with said side wall and a replaceable wear plate disposed on said side surface, said wear plate making sliding contact with said side wall.

15. An inclined hearth combustor as defined in claim 1, further comprising an ash transfer ram movably disposed between two of said stepped hearths, said ash transfer ram including a forward face and a wiper blade fixed on said forward face for clearing combustible materials on a top surface of the lower of said two stepped hearths.

16. An inclined hearth combustor as defined in claim 1, further comprising:

a row of laterally spaced air feed-tubes longitudinally embedded in one of said stepped hearths below a top surface thereof, said air feed-tube terminating at a front face of said hearth for delivering a combustion gas into said combustion chamber; and an air distribution plenum extending transversely across and intersecting with said row of air feed-tubes for simultaneously delivering the combustion gas to said air feed-tubes.

17. An inclined hearth combustor as defined in claim 16, wherein said air distribution plenum further comprises an elongate member having a central bore and a plurality of transverse holes communicating with said central bore for providing fluid communication between said central bore and said air feed-tubes.

18. An inclined hearth combustor as defined in claim 17, wherein said air distribution plenum further comprises a pinch control valve connected with said central bore for controlling the mixture of the combustion gas fed into said central bore.

19. An inclined hearth combustor as defined in claim 17, wherein said air distribution plenum further comprises a filter connected with said central bore for filtering the combustion gas fed into said central bore.

20. An inclined hearth combustor as defined in claim 1, wherein said wear strip supports said loader ram on said floor surface of said hopper.

* * * * *